US006990741B1

(12) United States Patent
Wells

(10) Patent No.: US 6,990,741 B1
(45) Date of Patent: Jan. 31, 2006

(54) DOOR FRAME ALIGNMENT METHOD SYSTEM

(76) Inventor: Ted C. Wells, 6744 E. Holly, Scottsdale, AZ (US) 85257

( * ) Notice: Subject to any disclaimer, the term of this patent is extended or adjusted under 35 U.S.C. 154(b) by 0 days.

(21) Appl. No.: 10/786,375

(22) Filed: Feb. 24, 2004

(51) Int. Cl.
*E04F 21/00* (2006.01)

(52) U.S. Cl. ..... 33/194; 33/413

(58) Field of Classification Search ..... 33/1 G, 33/194, 413, 613, 645, 756
See application file for complete search history.

(56) References Cited

U.S. PATENT DOCUMENTS

| | | | | | |
|---|---|---|---|---|---|
| 1,791,822 | A | * | 2/1931 | Lundquist | 33/194 |
| 3,197,874 | A | * | 8/1965 | Fox | 33/194 |
| 3,851,868 | A | * | 12/1974 | Lagasse | 33/194 |
| 4,123,753 | A | * | 10/1978 | Gravert | 33/716 |
| 4,395,144 | A | * | 7/1983 | Adams et al. | 29/33 K |
| 4,580,347 | A | * | 4/1986 | McKnight | 33/760 |
| 4,916,823 | A | * | 4/1990 | Kunze | 33/413 |
| 5,107,595 | A | * | 4/1992 | Stay et al. | 33/1 G |
| 5,167,073 | A | * | 12/1992 | Stein | 33/194 |
| 5,913,546 | A | | 6/1999 | Kuchenbrod et al. | |
| 6,141,880 | A | * | 11/2000 | Vircks | 33/1 G |
| 2002/0170189 | A1 | * | 11/2002 | Cheatham | 33/194 |

* cited by examiner

*Primary Examiner*—G. Bradley Bennett
(74) *Attorney, Agent, or Firm*—Gregory J. Nelson

(57) ABSTRACT

A door frame aligning system having a squaring system which includes a reel and guides securable at the four corners of a door frame. A line extends from the reel about the guides in criss-cross fashion. If the door frame is square and planar, the line will lightly intersect in the center of the frame opening. The second part of the system is a threshold spreader which is attachable across the threshold to adjust the opposite jamb frame member to a precise parallel position.

5 Claims, 2 Drawing Sheets

DOOR FRAME ALIGNMENT METHOD SYSTEM

FIELD OF THE INVENTION

The present invention relates to a tool and more particularly a door-framing tool for squaring and properly aligning door frames, particularly steel door frames, prior to installing a door within the frame.

BACKGROUND OF THE INVENTION

In order to fit properly, the frame in which a door is to be installed must be entirely square and plumb. This means that the vertical and horizontal jambs must all be in the same plane and, further, the vertical jamb portions must be precisely parallel. If the door jambs are out of square, that is one corner is not in planar alignment with the others, the door will not fit or hang properly. Similarly, if the vertical jambs are not precisely parallel, the door will not fit and either unsightly gaps will exist or excessive trimming will be necessary at the time of installation.

In recent years, metal framing is becoming more common in both commercial and in some residential applications. Metal framing offers a number of advantages in terms of cost, dimensional accuracy and resistence to environmental conditions.

As indicated above, framing, both metal and wood, must be precise in order for the door secured to the frame to fit properly. However, with metal framing, it is much more difficult to position and realign frames once they have been secured. In this respect, wood is much more forgiving and easier to adjust to using shims than metal. Metal frame materials are often secured by sheet metal screws which are difficult to remove if realignment is necessary.

Therefore, it is important to initially and properly align the frame, whether it be metal or wood, to provide for ease of installation of the door. Often, framing is installed by one trade then the doors are subsequently installed at a later date by another trade. Thus, if realignment or adjustment is necessary, it may become necessary to recall the framers for corrective action which adds considerably to the expense and job delays.

Various devices can be found in the prior art for accurately framing a door opening. U.S. Pat. No. 3,753,556 discloses a doorjamb jig. This device sets the door frame so the door frame will be plumb in both vertical and horizontal positions.

U.S. Pat. No. 5,913,546 discloses a one-piece door framing tool for aligning metal wall studs within a steel doorway. The invention comprises spacer legs which fit snugly around the wall stud. The spacer legs are joined by two cross members. In use, the tool is snugly fitted around a metal wall stud and using the handle, the metal wall stud is maneuvered into a space within the door frame. The spacer legs of the tool serve as an alignment mechanism to create an equal gap in each side of the metal wall stud from floor to ceiling.

As indicated above, there are various devices for assisting and properly installing an opening around a frame. However, despite the existence of these various devices, none facilitate precise alignment of the door frame, insuring that the frame elements are planar and further insuring that the vertical frame members are precisely parallel. Accordingly, there exists a need for an effective and easy-to-use door alignment system which will accomplish these results.

It is therefore an object to provide a door alignment system for use in aligning and squaring a door frame, particularly for application to metal door frames.

BRIEF SUMMARY OF THE INVENTION

Briefly, the objects and advantages of the present invention are achieved by an alignment system, according to the invention, which has a squaring system temporarily securable to a door frame during installation of the frame so that adjustment of the frame can be accomplished to insure that the corners of the frame are planar. The door squaring system consists of a reel rotatively mounted on a housing. The reel has a spool and includes a ratchet mechanism to prevent the spool from rotating in one direction. A line is attached to the reel and is extended over and around corner guide members. Each of the corner guide members has a body and a guide which may be a wheel. The body on each of the corner guide includes fastener means so that the members can be attached at selected locations to a metal door frame. The fastener means may be magnets and the corner attachment guide members may also include through bores so that these members may be temporarily attached to wood framing members as well.

In use, the reel is secured to the frame at a location, as for example abutting the doorstop near the bottom end of one of the vertical framing members. The corner guide members are secured at other selected locations such as abutting the doorstop at the upper end of the two vertical frame members and the lower end of the opposite vertical members. The line can be payed out to extend in criss-cross fashion from the reel to the opposite upper corner, then horizontally to the upper corner of the frame member on which the spool is located and back to the lower end of the opposite vertical frame member or jamb. If the corners of the frame or jamb are square, the line will form an intersection at a mid-point location within the opening. If the door is not square, that is the jamb members are not planar, then the line will not form an intersection indicating to the installer that further adjustment alignment is necessary.

The system also includes a jamb spacing system which includes a spreader plate which is placed in the threshold between the lower end of the vertical jambs. The spreader plate has a horizontally adjustable track and end members which are engageable with the opposite jambs. The end members are adjustable to accommodate door jambs variously dimensioned. The installer can then, by extending the retracting threshold track, establish precise parallelism between the vertical jambs.

BRIEF DESCRIPTION OF THE DRAWINGS

The above and other objects and advantages will become more apparent from the following description, drawings and claims, in which:

DETAILED DESCRIPTION OF THE DRAWINGS

Turning now to the drawings, FIGS. 1 through 4A illustrate the door alignment portion of the system. The door alignment portion of the system is generally designated by the numeral 10 and is shown in conjunction with a conventional door frame having opposite vertical jambs 12 and 14 which at their upper end are interconnected by a horizontal header or jamb 16. The jambs 12 and 14 include a stop 19 which extends around the opening against which the door, when installed, will abut. The jamb assembly is installed to vertical and horizontal framing members or studs. The framing members or studs and jambs may be wood, but the present system has particular application to insulations using metal studs and framing members.

Figures 1, 2, 2A, 3, 4, 4A:
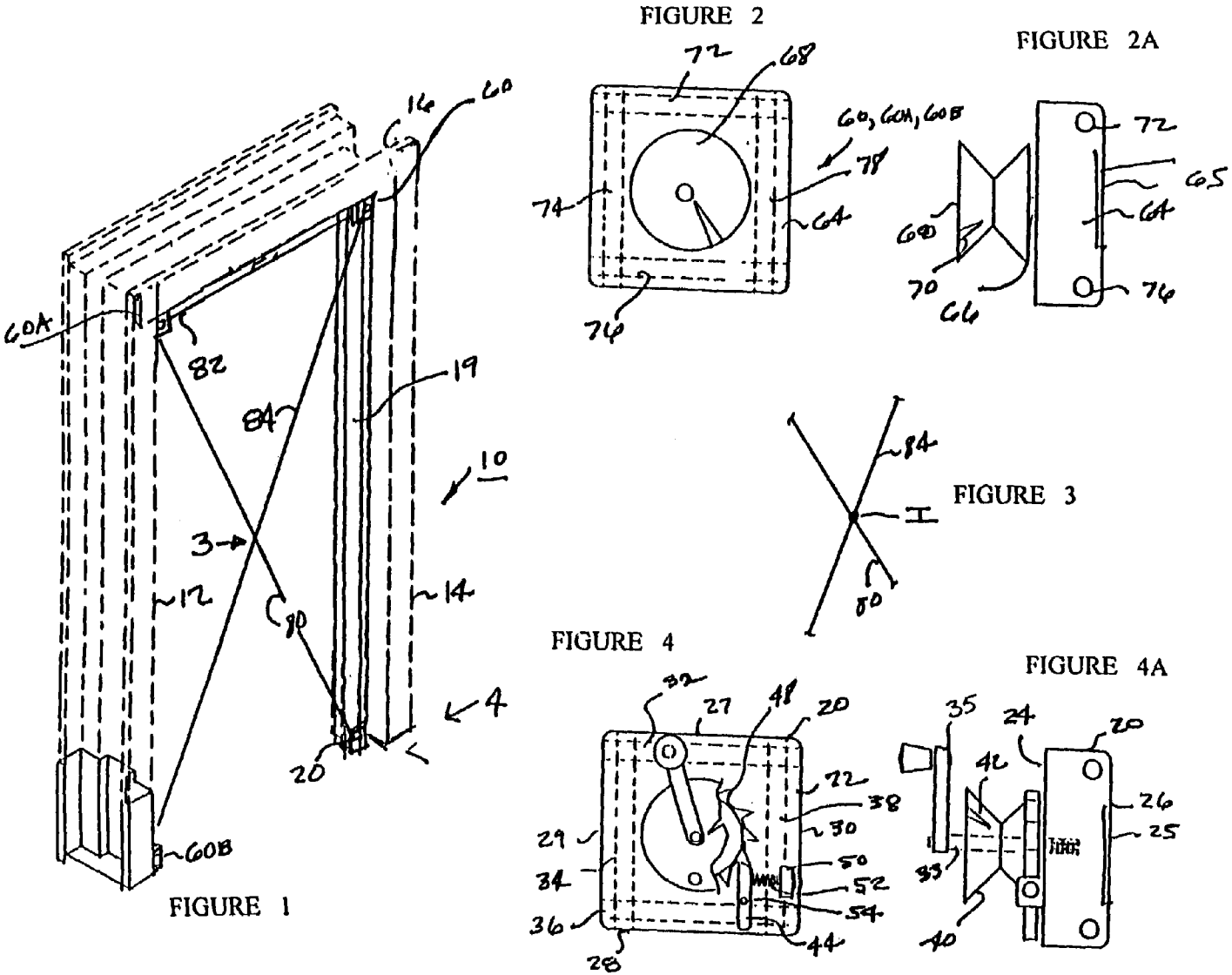
FIG. 1 is a perspective view showing the door-alignment position of the system installed in a typical door frame, the frame being shown in dotted lines.
FIG. 2 is a front view of the corner guide members.
FIG. 2A is a side view of the corner guide members shown in FIG. 2.
FIG. 3 is a detail view of the intersecting lines when an opening is properly squared.
FIG. 4 is a front view of the reel.
FIG. 4A is a side view of the reel.

The system includes a reel 20, as shown in FIGS. 4 and 4A. The reel 20 includes a housing 22 which may be of any convenient shape but is shown as having a front surface 24 and a rear surface 26 which is parallel to the front surface. The body has opposite top and side walls 27, 28, 29 and 30. A magnet 25 is provided in the rear wall 26 and through bores 32, 34, 36 and 38 extend through the body for reception of fasteners.

A shaft 33 is rotatively mounted in bearings in body 20 and extends from the front surface 24 terminating at a crank or handle 35. A spool 40 is secured to the shaft for rotation therewith. The spool has a generally V-configuration and is provided with a notch 42 for securing or tying-off a line or cord. A ratchet mechanism includes a pawl 44 which engages a ratchet wheel 48 secured to the inner surface of the spool 40. Thus, it will be seen that rotation of the spool in a clockwise direction is restricted by the pawl. The pawl may be disengaged by applying an outward force to the knob 50 to overcome the biasing force of spring 52. Note that the pawl is pivotal about pivot point 54.

In addition to the spool, the system includes at least three corner guide members 60, 60A and 60B. The corner guide members are identical in construction and FIGS. 2 and 2A are representative of the construction of members 60, 60A and 60B. Each includes a body 64 which rotatively supports a shaft 66. The end of the shaft 66 carries a roller or wheel 68 having a generally V-configuration. Again, a notch 70 is provided for tying-off or securing the end of a line. The body may be provided with one or more through bores 72, 74, 76 and 78 extending between the opposite sides of the body as well as extending from the front to the rear of the body. These bores accommodate fasteners such as nails or screws for temporary securement to wooden members. In addition, the body and the corner members include a magnet 65 so that these guide members may be temporarily, magnetically secured to metal frame structures.

In use, the reel 20 is secured either by means of the integral magnet 25 or by means of screws or fasteners in one or more of the through bores to a location at one of the four corners of the door opening. In FIG. 1, the reel 20 has been secured to the lower end of the right hand vertical door jamb with the rear surface abutting the doorstop 19 on the hinge side. Corner guide members 60, 60A and 60B have been secured either by fasteners or magnetically to the upper corners of jamb members 12 and 14 and to the lower end of jamb 12 also abutting the doorstop. The line on the reel of the spool 20 is then payed out, criss-cross fashion, as shown in FIG. 1, extending angularly at 80 to the upper corner member 60, horizontally at 82 to the member 60A and downwardly and angularly at 80 to member 60B. The line can then be pulled taught by means of the handle 35 on the spool. Rotation of the spool in the opposite direction is resisted by the ratchet mechanism engaged by the pawl. Once the line is taut, the intersection location "I" of lines 80, 84 shown in FIG. 3 is observed. If the lines barely touch, the door frame is true and square as all of the corners are in the same plane. If any of the corners of the door are out of alignment, the line will not lightly intersect. The installer can then make the necessary adjustments to the frame to bring the lines into light contact.

Figure 5:
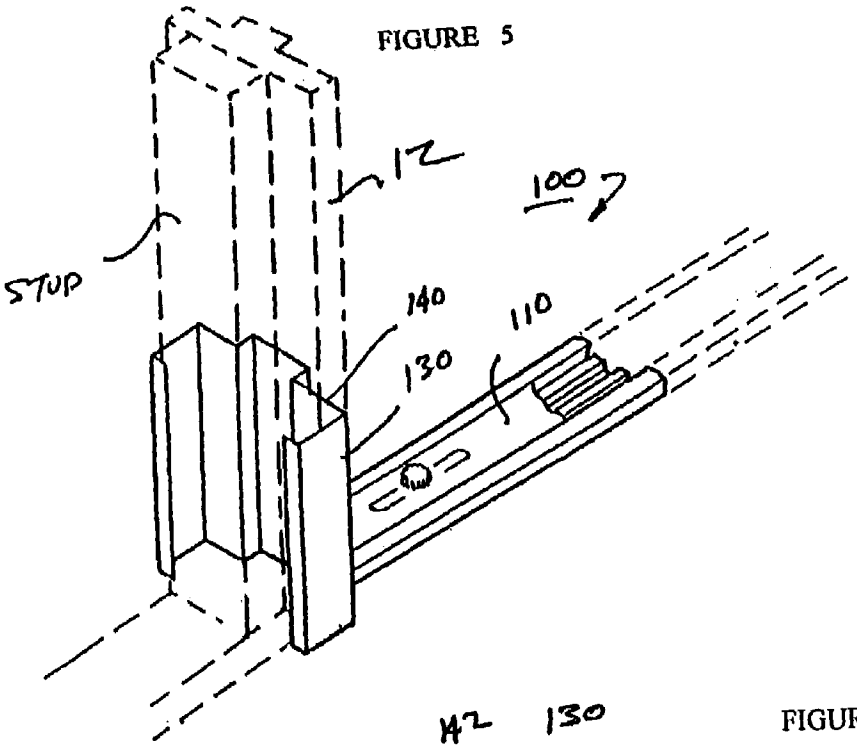
FIG. 5 is detail view of the spreader portion of the system for adjusting the opposite vertical jambs to a precise parallel position.
Figure 6:
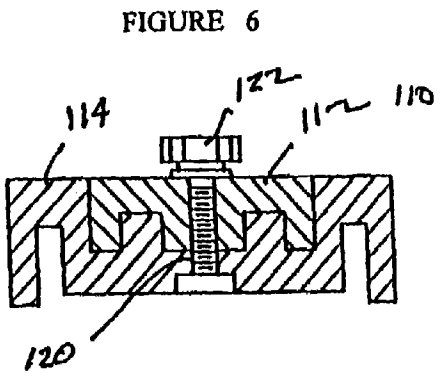
FIG. 6 is a sectional view taken along 6—6 of FIG. 5.
Figure 7:
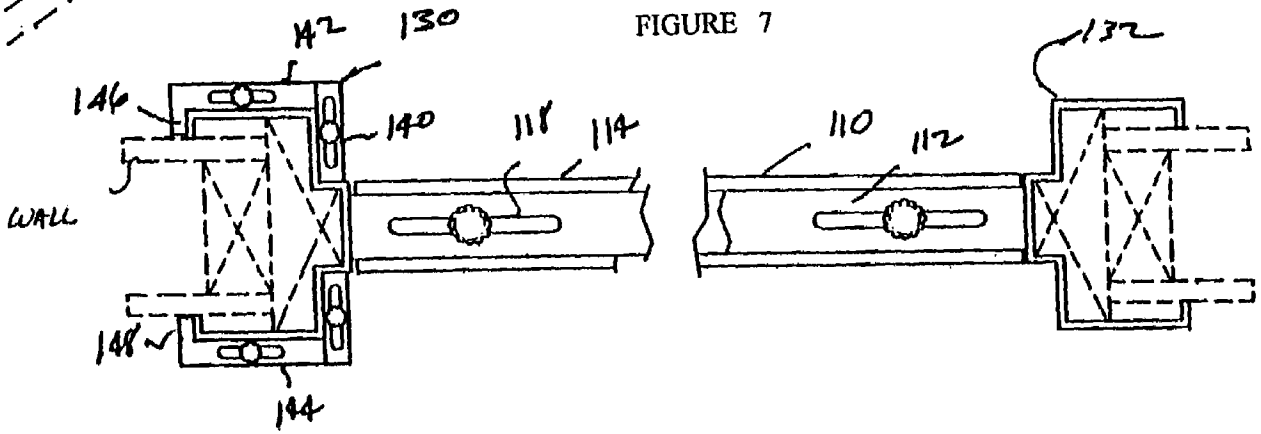
FIG. 7 is a top view showing the spreader assembly in position extending across threshold of the opening.

Once the frame and jamb are properly aligned, the installer can then proceed with the next step which is insuring that the opposite jamb members 12 and 14 are in precise parallel relationship. The spreader portion of the system for accomplishing this is shown in FIGS. 5 through 7 and generally indicated by the numeral 100. The spreader plate includes an axially adjustable threshold track 110 connected. The track has a center plate 112 slidable relative to track 114.

A pair of studs 120 extend from the track 114 through the slots 118 in the track. Thus, the overall length of the track can be adjusted by loosening the associated nut 122 and adjusting the plates 110, 114 relative to one another and thereafter tightening the nut. Track 110 is attached to head 130 and plate 12 is attached to head 132.

Each of the head members 130, 132 include a front jamb plate 140, spaced-apart side jamb plates 142, 144 and rear plates 146, 148. The jamb plate are adjustable and similarly constructed, as seen in FIG. 8. Each defines a slot 150 which receives a threaded member 152 extending from the fixed jamb plate. A fastener 156 engages the threaded member and it will be apparent by loosening the threaded member, the width of the plates can be adjusted to accommodate jambs having different dimensions. Similarly, the spreader plate assembly can also be adjusted to accommodate jambs having different thicknesses. Accordingly, rear plates can be adjusted by means of the threaded slots in the top of each wing plate. The nuts can be loosened to position the wing plates as required.

In use, the threshold spreader assembly is installed across the threshold at the bottom of the door jambs as seen in FIGS. 5 and 7. The jamb engaging members are adjusted to fit the configuration and dimensions of the jambs which may vary to some extent. The rear plates will extend around the jamb so that adjustment in either a retracting or extending direction may be accomplished. With the spreader assembly in position, the installer can then, using a measurement scale and level, insure that the jambs are both vertical and in parallel. The square aligning procedure having been previously completed or may be checked again.

From the foregoing, it will be seen that the present invention provides a system for accurately and effectively aligning door jambs. With the system of the present invention, the installer can accurately insure that the door jamb is properly aligned and that the vertical jamb components are parallel to one another.

It will be obvious to those skilled in the art to make various changes, alterations and modifications to the invention described herein. To the extent these various changes, alterations and modifications do not depart from the spirit and scope of the appended claims, they are intended to be encompassed therein.

I claim:

1. An adjustment system for a metal or wooden door frame having opposite vertical frame members, said alignment system comprising:

(a) a reel having a spool with a line attached, said reel having a spool with ratchet means, a first fastener means for directly securing the reel to a location on a wooden frame and second fastener means for directly securing the reel to a location on a metal frame; and (b) guide members having first fastener means for directly securing said guide members to selected locations on wooden frame members and second fastener members for directly securing the guide members to a metal frame whereby said reel and guide members may be located to extend said line in criss-cross fashion within said frame members to provide the installer a visual indication of the proper alignment.

2. The adjustment system of claim 1 wherein said guide member each include a spool.

3. The adjustment system of claim 1 wherein said frame members are metal and said second fastener means comprises a magnet.

4. The adjustment system of claim 1 further including a spreader means including an axially adjustable threshold plate having head member at opposite ends engageable with said frame member.

5. The adjustment system of claim 4 wherein said head members are adjustable to conform to frame members of varying shape and dimensions.

* * * * *